US005806723A

United States Patent [19]

DuBose

[11] Patent Number: 5,806,723

[45] Date of Patent: Sep. 15, 1998

[54] DEVICE FOR LAVAGING

[76] Inventor: Robert W. DuBose, 8602 E. Whitewater Dr., #210, Anaheim Hills, Calif. 92808

[21] Appl. No.: 682,364

[22] Filed: Jul. 17, 1996

[51] Int. Cl.[6] ..... B65D 37/00

[52] U.S. Cl. ..... 222/211; 141/381; 128/203.15

[58] Field of Search ..... 222/158, 211, 222/633; 141/381; 73/427; 128/203.15

[56] References Cited

U.S. PATENT DOCUMENTS

| | | | |
|---|---|---|---|
| 2,543,427 | 2/1951 | Warne | 141/381 |
| 4,106,673 | 8/1978 | Donoghue | 222/211 |
| 5,316,054 | 5/1994 | Hall et al. | 215/DIG. 8 |
| 5,330,081 | 7/1994 | Davenport | 222/211 |
| 5,662,249 | 9/1997 | Grosse | 141/381 |

FOREIGN PATENT DOCUMENTS

| | | | |
|---|---|---|---|
| 168625 | 9/1959 | Sweden | 222/211 |

*Primary Examiner*—Philippe Derakshani

*Attorney, Agent, or Firm*—Donald E. Stout

[57] ABSTRACT

An apparatus and associated method for preparing a saline solution, lavaging, and postural draining. The apparatus having a container with flexible side walls and fitted with a removable dispensing cap. Markings are provided on the container for indicating when the desired quantity of saline solution has been prepared. The dispensing cap is specifically configured with a dispensing tip for sealing against a nostril. The tip is in fluid connection with a tube that is connected to the interior portion of the dispensing cap and extends into the container. The tube acts to draw the saline solution from the base of the container and out throughout the dispensing tip when the side walls of the container are compressed. A cover with an integral measuring device is removably fitted over and seals the cap. A typical procedure involves using the cover to measure salt and transfer it into the container. Water is then added to the level of the markings. Following this, the dispensing cap and cover are then attached to the container and the solution is mixed. Then, to begin lavaging, the cover is removed, the tip fitted against a nostril, and the side walls of the container are compressed. After lavaging, clearing and draining of the nasal cavity is commenced.

14 Claims, 2 Drawing Sheets

DEVICE FOR LAVAGING

BACKGROUND OF THE INVENTION

This invention relates to devices and methods for preparing and dispensing normal saline solutions and more particularly to devices and methods for preparing lavaging solutions and dispensing those solutions into the nasal cavity to relieve the effects of sinusitis.

Sinusitis is possibly the number one chronic illness in the United States. It is estimated that 30 to 50 million Americans suffer from the symptoms of sinusitis. These symptoms commonly include inflammation of the sinuses or a sinus, especially in the nasal region, nasal congestion and postnasal drip. However, symptoms can also include: headaches, coughing, nasal discharge, chronic throat clearing, raspy voice, sore throat, sleep disorders, snoring, fatigue, bad breath, irritability, and depression.

Sinusitis is an inflammation of the membranes lining the sinuses that may or may not be accompanied by a bacterial infection. There are many causes of sinusitis. Allergies to dust, pollen and pet dander, indoor air pollutants such as cigarette smoke, rug shampoo, and formaldehyde (frequently used in manufacturing of carpeting, particle board and plywood), and outdoor pollutants can all cause such inflammation.

Once the sinuses are inflamed, they are more vulnerable to bacterial infection. For example, if nasal congestion from a cold gets worse instead of clearing up after a few days, it may be because the sinus membranes, inflamed and weakened by the cold virus, have been attacked by bacterial infection. Once infected by bacteria, the sinus membranes are more sensitive to allergens and irritants and become even more inflamed. Thus, the cycle of chronic sinusitis begins which, if not properly treated, can lead to acute sinusitis.

Symptoms of acute sinusitis are: yellow or green nasal discharge, pressure around the eyes, cheeks, and forehead, fever of 102° or greater. The symptoms of acute sinusitis should be treated by a doctor.

Typically known home treatments for sinusitis include the use of nasal decongestant sprays, decongestant tablets, and other medicines. Over-the-counter nasal decongestant sprays can be effective when used for a few days. However, these nasal sprays are expensive and additionally, can become addicting. If used for more than a few days, users generally experience what is called a "rebound effect". Symptoms of this effect include increased congestion when the use of the nasal spray is discontinued, which in turn, necessitates the need for additional nasal spray.

Decongestant tablets and medicines can also be effective when used on a temporary basis. However, these methods are also very expensive and have other associated drawbacks, including a "rebound effect". For instance, these medicines generally cause drowsiness, or in the alternative, are supplied with caffeine. This limits the useability and desirability of such medicines.

However, an effective suggested treatment developed by the present inventor, is nasal irrigation or lavage. Lavage is a drug free treatment for sinusitis which can be administered at home. The procedure uses a saline solution which is dispensed into the nasal cavity to cleanse and wash away particulate matter and thicker dried mucus. This treatment allows the sinuses to drain normally and heal without the use of medicines. Further, there is no drowsiness, no caffeine and no rebound effect.

Saline solution is generally supplied in a dispenser bottle fitted for a particular use. Uses include lavage and the cleansing of contact lenses as well as many other hygiene and personal uses. A dispenser bottle filled with saline solution is generally quite expensive, however, especially when considering the low cost of the components. Because of the relatively large volumes of solution utilized during a lavaging procedure, the cost of saline solution purchased at retail is prohibitive. Additionally, each time a bottle is emptied, it is typically discarded, increasing loads on our already burdened landfills. An additional problem occurs when a bottle of solution is emptied before lavaging or lens cleaning is completed, requiring a trip to the store. This can be very inconvenient.

In the alternative, sterile saline solution may be made at home using household ingredients. There are methods and devices available for preparing saline solutions of various concentration. However, these devices and methods require appropriate measuring, stirring and pouring equipment. Further, the methods can be confusing. There is also a concern for cleanliness and contamination whenever the solution is prepared by a user. Thus, there is a need for a simple method and apparatus for preparing a saline solution using household ingredients that is simple, inexpensive, and not easily contaminated.

Current lavaging equipment may include any type of dispenser that can be filled with a saline solution and then inject that solution into the user's nasal cavity. These dispensers, although useable, may be crude, inconvenient, expensive, and messy. For example, some dispensers require the dispensing nozzle to be pulled open and pushed closed. This handling can contaminate the dispensing tip as well as the saline solution. Additionally, these dispensing tips do not comfortably seal against a user's nostril. Thus, there is a need for a simple dispenser for dispensing a saline solution that is inexpensive, difficult to contaminate, and easy to fill with saline solution. There is also a need for a dispenser tip that can comfortably and effectively seal against a human nostril.

Another problem with current lavaging apparatus and techniques occurs after lavaging, during which time the nasal cavity tends to continue draining. If this drainage is blocked or otherwise disturbed, sinusitis is more likely to reoccur. Thus, there is a need for a method to allow for the complete and unobstructed drainage of the nasal cavity after lavaging.

For the foregoing reasons, there is a need for an apparatus and method for preparing and dispensing a saline solution which is simple to use, capable of being prepared and administered in most any location and which is inexpensive.

SUMMARY OF THE INVENTION

The present invention is directed to an apparatus and associated method for preparing and dispensing a saline solution into the nasal cavity. An apparatus having the features of the present invention comprises a container with flexible side walls and fitted with a removable dispensing cap. The container has at least one marking to indicate the desired quantity of water necessary for preparing the saline solution. The dispensing cap is removably attached to the container in a liquid tight fashion and has an axial aligned hollow center. The interior portion of the cap may be fitted with a tube which extends into the container and the outer end of the cap is fitted with a dispensing tip. The dispensing cap is also fitted with a removable cover for positively sealing the hollow center of the cap. The cover has a built in measuring container and a specifically configured shape for sealing and ease of removal.

In another aspect of the invention, a method for lavaging the nasal cavity is disclosed which comprises a first step of first preparing a lavaging solution by measuring a predetermined amount of non-iodized salt into a dispensing container that has flexible side walls. Water is then added to make a predetermined amount of lavaging solution. The container is capped with a dispensing cap and the solution is mixed to dissolve the salt. The solution may then be heated until it reaches a temperature comfortable for lavaging.

The lavaging solution is directed into the nasal cavity by sealing the upper end of the dispensing cap, which is fitted with a specifically configured dispensing tip, against a nostril opening following which the container side walls are compressed to force the solution out of the container, through the cap and into the nasal cavity.

An important feature of the present invention is the convex shape of the dispensing tip. The tip is particularly designed to comfortably fit against a human nostril and to allow lavaging without leakage of the solution.

Another important feature of the present invention is the design of the removable cover. The design incorporates a cover that seals the dispensing tip while reducing the chance of contaminating the tip or the saline solution. The cover also incorporates an integral measuring device which is sized to measure a predetermined amount of salt. This greatly simplifies the process of making the saline solution, eliminating the need for a separate measuring device or stirring device.

Yet another important feature of the present invention is the dispenser apparatus itself. The dispenser draws the saline solution from the base of the dispensing container such that the apparatus can be used while the user remains in the upright position. The dispenser also incorporates markings to indicate when the appropriate amount of water or cleaning solution has been added.

Another important aspect of the invention is a novel technique for postural draining. By following the described postural draining techniques of the invention, a user can reduce or eliminate the excess drainage that is common with current lavage techniques. The inventive postural draining techniques also improve the quality of the lavage and reduce the chances of reoccurring sinusitis.

Yet another important aspect of the present invention is the ability to use the dispenser assembly for other purposes. For example, the dispenser may be used for cleaning and disinfecting contact lenses. In this application, the invention greatly simplifies home preparation of saline solution for use with contact lenses.

The invention, together with additional features and the advantages thereof, may be better understood by reference to the following description taken in conjunction with the accompanying illustrative drawings.

DETAILED DESCRIPTION OF THE PREFERRED EMBODIMENT

Figure 1:
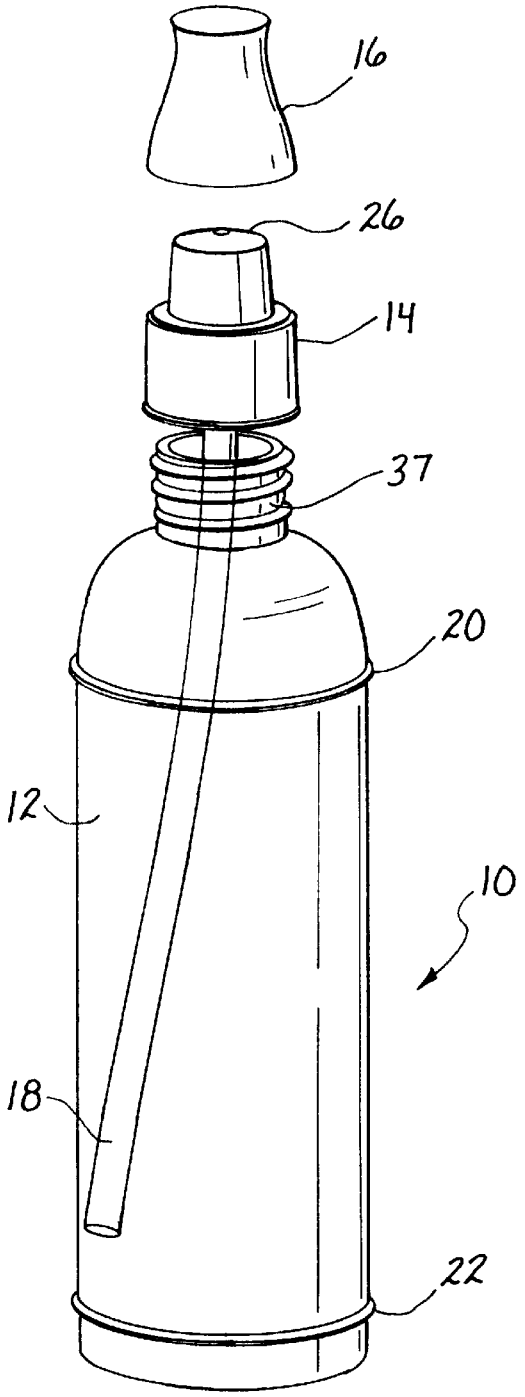
FIG. 1 is a perspective view of an embodiment of the present invention for preparing and dispensing a saline solution formed in accordance with the principles of the present invention.

Referring now to FIG. 1, a preferred embodiment for preparing and dispensing a physiologic normal saline solution formed in accordance with the present invention is shown. The dispenser assembly 10 is comprised of a container 12, a dispensing cap 14 and a cover 16. A tube 18 is preferably connected to the interior portion of the dispensing cap 14 and extends into the container 12. Markings 20 and 22 are provided on the container 12 to indicate when proper fluid levels are reached.

Figure 2:
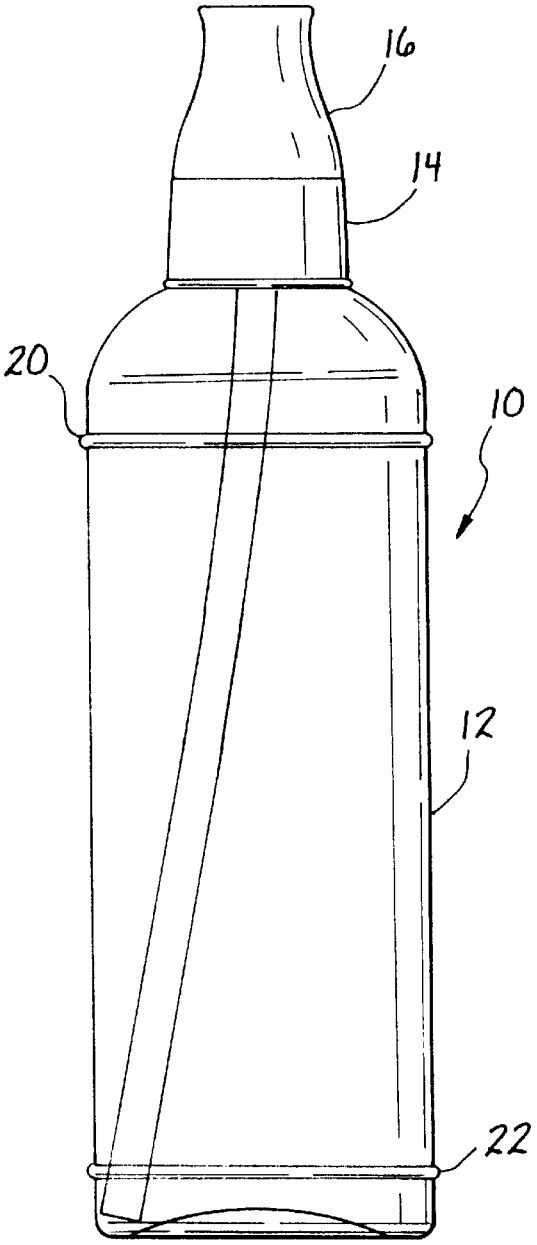
FIG. 2 is a side view of the embodiment of FIG. 1 showing the inventive apparatus, including a container, a dispensing cap, and a cover in the fully assembled configuration.
Figure 3:
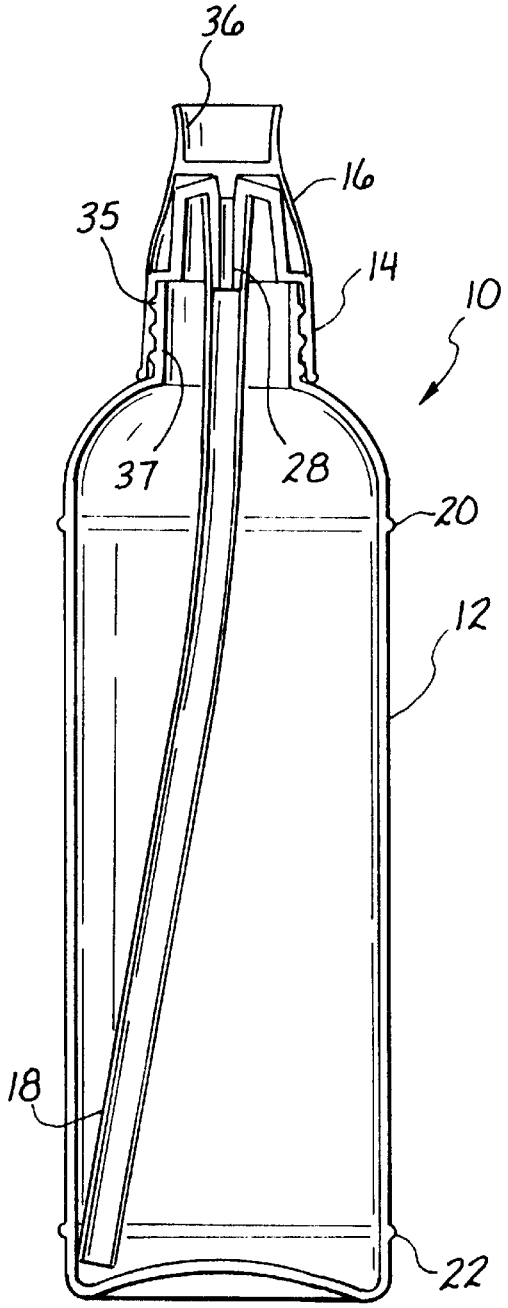
FIG. 3 is a cross-sectional view of the embodiment of FIG. 1 showing the container, the dispensing cap, and the cover in the fully assembled configuration.

Referring to FIGS. 1 through 3, the dispenser assembly 10 will now be described in greater detail. The container 12 has flexible side walls that can easily be compressed by hand. The container 12 is preferably made from a translucent material such as a clear flexible plastic. The clearer the container 12, the easier it is to determine liquid levels and inspect for cleanliness. The container 12 is preferably equipped with markings 20 and 22 for indicating when the desired quantity of saline solution has been prepared. The markings may be in any convenient form such as printed level lines, integral grooves and rings, or similar. Using the markings 20 and 22 in conjunction with the translucent container 12, is a simple way to determine liquid levels.

Preferably, container 12 can withstand heat. In most applications this may include containing warm water, but may also include being subjected to heating such as in a microwave oven. Being able to add solution to the container 12 and then heating the entire dispenser assembly 10 simplifies the preparation and warming of the solution. In some applications, particularly those that require a sterile solution, it may be desirable to heat the solution to temperatures above its boiling point. In these applications, a special, high temperature container 12 may be provided.

Figure 4:
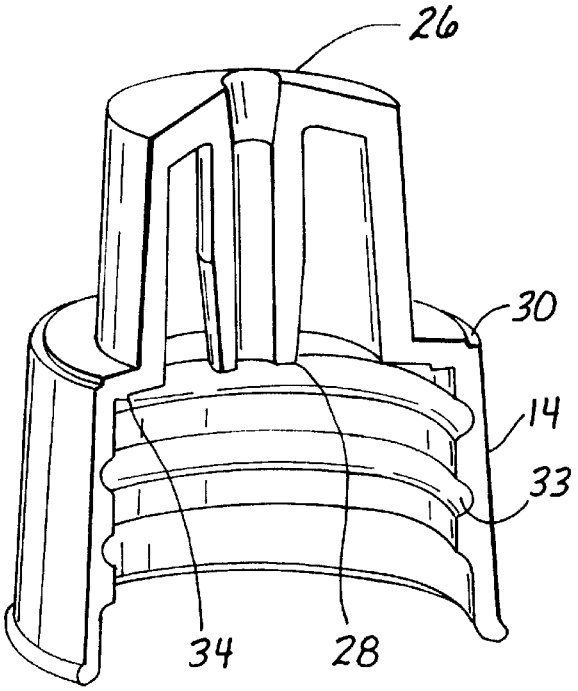
FIG. 4 is a sectional view of a dispensing cap formed in accordance with the present invention.

Referring now to FIG. 4, the dispensing cap 14 of the FIG. 1 embodiment is shown in greater detail. The dispensing cap 14 may have a specifically configured dispensing tip 26 for sealing against a nostril (not shown). The dispensing tip 26 preferably has a diameter that is slightly larger than a large nostril and is convex shaped to provide a seal. The dispensing tip 26 is in fluid connection with a tube 18 (FIG. 3) that is connected to the interior portion of the dispensing cap 14 and extends into the container 12. The tube 18 is preferably connected to the dispensing cap 14 using a tapered tube nipple 28. However, alternative methods of connecting the tube 18 to the dispensing cap 14 may be used, including using a single piece tube and dispenser cap assembly, or by inserting the tube 18 into a tight fitting bore within the cap 14, or similar, and the tube and tube nipple may not be supplied for certain applications, such as contact lens care. The tube nipple 28 provides fluid connection between the tube 18 and the dispenser tip 26.

The interior of the dispensing cap 14 is fitted with a sealing lip 34. When the dispensing cap 14 is attached to the container 12, the sealing lip 34 engages the container 12 and is compressed, ensuring a liquid tight fit. Preferably, the sealing lip 34 is an integral part of the cap 14. Dispenser cap 14 has a lock ring 30 for attachment to the cover 16.

The dispensing cap 14 may include threads 33 (FIG. 4) for threaded engagement with corresponding threads 35 on the neck of the container 12 (FIG. 3). However, attachment may be accomplished in any convenient fashion that allows a removable-assembly and is liquid tight. Other methods may include a ring and groove assembly, a compression fitting cap, a plug style cap, or the like.

Figure 5:
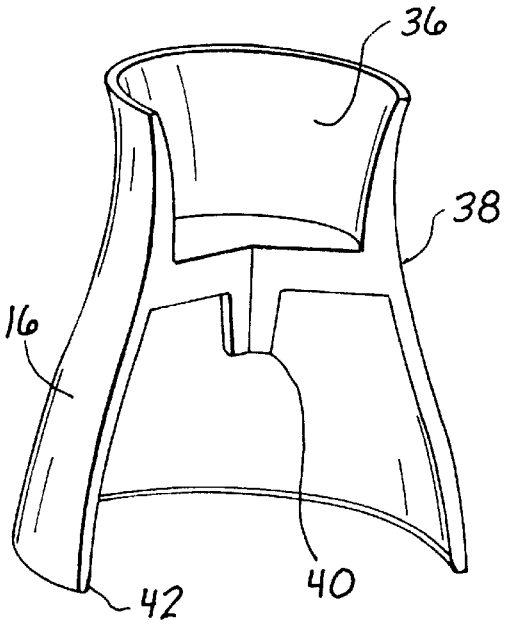
FIG. 5 is a sectional view of a cover formed in accordance with the present invention.

Referring now to FIG. 5, the cover 16 of the FIG. 1 embodiment is shown in greater detail. The cover 16 may be made from a flexible material such as a soft rubber or plastic. The cover 16 has a concave grasping region 38 for grasping the cover 16 during attachment and removal. The upper surface of the cover 16 may be formed to create a measuring cup 36. This measuring cup 36 is sized to hold a predetermined volume of salt (not shown). The predetermined volume is adjusted to coincide with the marking 20 (FIG. 3) such that when a quantity of salt necessary to fill the integral measuring cup 36 is added to container 12, water must be added to the level indicated by marking 20. This ensures a proper concentration of saline solution. Container 12 may have additional markings for different concentrations of solution.

Cover 16 is attached to dispensing cap 14 to provide a seal and to prevent contamination of the dispensing tip 26 and the saline solution. The cover 16 is attached using a snug fit and a locking ring 42. The locking ring 42 mates with the locking ring 30 on the dispensing cap 14. A plug 40 fits into the dispensing tip 26 to seal the dispensing assembly 10 and to ensure that the cover remains fixed to the dispensing cap 14. The plug 40 may be tapered to provide a sure fit. Alternative methods for attaching the cover 16 to the dispensing cap 14 may include, for example, a threaded assembly or a ring and groove assembly.

In an alternative embodiment of the present invention, the cover 16 may be fitted with measuring cups 36 of varying sizes for various applications, wherein each application requires a different concentration of saline-solution. For example, the dispensing assembly 10 may be configured for cleaning contact lenses. In this example, the dispensing tip 26 may be configured to dispense solution in a narrow stream, and may not include a tube 18 or tube nipple 28. In an alternate example, the cover 16 may not be equipped with a measuring cup.

In a typical application, a saline solution is first prepared. Preferably, this solution is a physiologic normal solution comprising 0.09% saline, though other solution concentrations, such as hypotonic or hypertonic saline may be used if desired. Starting with a fully disassembled and clean dispenser assembly 10, a predetermined quantity of salt is measured using the provided measuring cup 38. The measuring cup 38 is sized so that, when filled to an indicated fill line, exactly the solution concentration indicated for the dispensing assembly 10 will be obtained (typically physiologic normal saline solution). The cover 16 may be used as a scoop or the salt can be poured into the measuring cup 38. Preferably, non iodized table salt used, however any similar salt may be used. In one optional embodiment, it may be desired to include a cap for the assembly 10, beneath which could be disposed a supply of salt to be used to mix the solution.

In certain applications, an alternative to a pure saline solution may be desired. In these instances, an alternative compound or relieving compound is added to the water or may alternatively be added to a different liquid. These alternative compounds may be used alone or merely added to the salt. Alternative compounds may include, pharmaceutical and natural decongestants, pain relievers, cleansers, medicines, water softeners, and any other medicines found beneficial or desirable when lavaging. Alternative liquids may also include pharmaceutical and natural decongestants, pain relievers, cleansers, medicines, and any other liquids found beneficial or desirable when lavaging.

The salt, or alternative compound (not shown) is then transferred from the measuring cup 38 to the container 12. It is preferred that the cover 16 be used to both transfer the salt and to pour it into the container 12. This simplifies the procedure and reduces the opportunity for contamination. Water is then added to the container 12 until the solution reaches the water level indicator 20. Preferably de-ionized, purified, or distilled water is used, but clean tap water may also be used.

The dispensing cap 14 is then attached to the container 12. Preferably, this is a threaded assembly, but any means of attaching the cap 14 to the container which is water tight and easily removable may be used. Other methods of attaching and sealing the cap 14 to the container 12 include: a snug fit or compression assembly, a groove and seal assembly, exterior clamps, or any other similar methods.

The cover 16 may then be attached to the dispensing cap 14 to seal the dispensing tip 26. Preferably this is a snug fit or compression assembly which tightly seals the dispensing cap 14, but is easily removable. Attachment may be accomplished by holding the cover 16 in the grasping region 38 and pressing it onto the dispensing cap 14 until lock rings 30 and 42 mate. This procedure forces the plug 40 into the dispensing tip 26. The entire dispenser assembly 10 is then shaken to mix the saline solution, following which the dispenser assembly 10 is heated until the solution is warm. Heating may be accomplished by merely using warm water, by microwaving or by using any other similar means.

The cover 16 may then be removed from the dispensing cap 14. Removal is accomplished by holding the cover 16 in the grasping region 38 and compressing or twisting. The compression acts to flex the cover 16 which forces the plug 40 from the dispensing tip 26 and breaks the attachment at lock rings 30 and 42.

The dispensing tip 26 is then raised and pressed against a nostril to seal the dispensing tip 26 to the nostril. The container 12 is compressed, forcing solution into the nostril and the commencing lavaging process. Generally this is continued until most of the solution has been used.

After lavaging is completed, continued cleaning and draining of the nasal cavity may be required. This can be accomplished using postural draining techniques of the present invention. Postural draining is commenced by laying on one's back and holding the head slightly elevated. Although lying down is not required, it is preferable because of comfort and convenience. The head is preferably held facing straight upwards. Breathing is modified to deep long inhalations and exhalations through the nose. Periodically, the head should be rotated slightly to the side while breathing in and out. The head is rotated such that the most congested nostril remains predominantly higher or closest to the straight up position. While the head is rotated, mucus can be expelled as necessary. The mucus is preferably removed with the assistance of soft tissues or cloth. The process of deep breathing and removing mucus is continued until the nasal passages feel clear and relieved of the sinusitis. Typically, this process is continued from approximately 5 minutes, to over 20 minutes in severe cases.

For cleaning the dispenser assembly 10, the dispensing cap 14 and cover 16 are removed from the container 12 together. A small quantity of vinegar is added to container 12. Preferably, container 12 is fitted with a level line marker 22 to indicate the appropriate amount of vinegar to add. As described above, a translucent container. 12 along with an easy to identify marking 22 on the container wall is preferred, however, any alternative form of liquid level indicator may be used.

Household white vinegar is the preferred cleaning agent, but any vinegar, weak acetic acid, or non toxic cleaning solution will work. When combined with water, the vinegar forms a weak acetic acid that acts as a cleaning fluid. The water is added to the water level marker 20 to form a predetermined solution strength. By providing the liquid level markings 20 and 22, the process of making both the saline solution and the cleaning solution is greatly simplified. No other measuring devices are necessary.

After preparing the cleaning solution, the dispensing cap 14 and cover 16 are reassembled onto the container 12. The dispenser assembly 10 is then shaken for a brief period to mix the cleaning solution and to clean the interior of the container 12, the tube 18 and the cap 14. The cover 16 is then removed and the cleaning solution is expelled through the dispensing tip 26. The cleaning solution is allowed to flow over the exterior of the dispensing cap 14 and is also directed over the cover 16. Cleaning is generally completed when the entire contents of the cleaning solution are expelled. A visual inspection of the dispenser assembly 10 may be used to determine if additional cleaning is necessary.

Although several embodiments of the invention have been described, it is to be understood the invention is not to be limited to those descriptions. Various changes and alterations may be made to the design and arrangement of the individual components and methods without departing from the spirit and scope of the invention as understood by one with skill in the art.

What is claimed is:

1. An apparatus for preparing and dispensing a solution that comprises:

a container having flexible side walls and at least one opening for containing said solution;

a cap with an axially aligned hollow center which is removably mounted to the container opening in a liquid-tight fashion for directing the solution from the interior of the container to a desired location, the cap having a lower end and an upper end, the lower end being connected to a tube which extends into a lower part of the container and the upper end being a dispensing tip; and a removable cover for positively sealing the hollow center of the cap, the cover having opposed first and second chambers, the first chamber being oriented downwardly for enclosing the hollow center of said cap when said cover is disposed to seal said cap and the second chamber being oriented upwardly for functioning as a measuring container for measuring a desired quantity of one compound forming said solution.

2. The apparatus for preparing and dispensing a solution as described in claim 1, the solution comprising a saline solution within a range from hypotonic to hypertonic saline.

3. The apparatus for preparing and dispensing a solution as described in claim 1, wherein the container further comprises at least one designation to indicate the desired quantity of water for preparing the solution.

4. The apparatus for preparing and dispensing a solution as in claim 1, wherein the container further comprises a liquid level marker that indicates a level of cleaning agent to be added when cleaning the apparatus.

5. The apparatus for preparing and dispensing a solution as in claim 4, wherein the cleaning agent is vinegar.

6. An apparatus for relieving nasal congestion and the effects of sinusitis through lavaging comprising:

a container having flexible side walls and at least one opening for containing a lavaging solution, the container further having at least one designation to indicate when a desired quantity of water is contained for preparing the lavaging solution;

a relieving compound;

a cap with an axially aligned hollow center which is removably mounted to the container opening in a liquid-tight fashion for transferring the lavaging solution from the interior of the container to the nostril, the cap having a lower end and an upper end, the lower end being connected to a tube which extends into the lower part of the container and the upper end having a rounded convex dispensing tip for sealing against a human nostril; and a removable cover for positively sealing the hollow center of the cap, the cover having a measuring container for measuring a desired quantity of relieving compound to mix with the water held by the container;

wherein the contained lavaging solution can be directed into the nasal cavity by sealing the dispensing tip against a nostril opening and compressing the container side walls to force the solution up the tube, through the cap, and into the nasal cavity.

7. The apparatus as described in claim 6, wherein the container and tube are sufficiently transparent to facilitate liquid level measuring, cleaning and inspection.

8. The apparatus as described in claim 6, wherein the container comprises materials that are resistant to weak solutions of acetic acid.

9. The apparatus as described in claim 6, wherein the container can withstand heat and microwave energy such that the lavaging solution may be heated in the container.

10. The apparatus as described in claim 6, wherein the relieving compound comprises a combination of non-iodized salt and a medicine for treating sinusitis.

11. The apparatus as described in claim 6, wherein the relieving compound comprises non-iodized salt.

12. The apparatus as described in claim 6, wherein the lavaging solution comprises from 3 percent to 25 percent non-iodized salt.

13. The apparatus as described in claim 6 wherein the cover is a single-piece flexible member with an upper section and a lower section, the upper section being generally thimble-shaped for measuring and transferring the relieving compound to the container and the lower section also being generally thimble-shaped for fitting over and positively sealing the upper end of the cap, said upper section and said lower section being separated by a flexible bridge, and said flexible bridge having a plug for positively sealing an opening in the dispensing tip, wherein the cover is removable from the cap by compressing the bridge and lifting the cover upwardly away from the cap.

14. The apparatus as described in claim 13, wherein the dispensing tip further comprises a substantially rounded and slightly convex upper surface with an outside diameter slightly larger than a large nostril opening, said tip having an orifice for allowing a smooth flow of lavaging solution.

* * * * *